US009250045B2

(12) United States Patent
Bezuidenhout et al.

(10) Patent No.: US 9,250,045 B2
(45) Date of Patent: Feb. 2, 2016

(54) BOOSTER ASSEMBLY

(71) Applicant: AEL MINING SERVICES LIMITED, Sandton (ZA)

(72) Inventors: Hendrik Cornelius Bezuidenhout, Pretoria (ZA); Pieter Stephanus Jacobus Halliday, Randburg (ZA)

(73) Assignee: AEL MINING SERVICES LIMITED, Sandton (ZA)

( * ) Notice: Subject to any disclaimer, the term of this patent is extended or adjusted under 35 U.S.C. 154(b) by 0 days.

(21) Appl. No.: 14/352,606

(22) PCT Filed: Oct. 17, 2012

(86) PCT No.: PCT/ZA2012/000075

§ 371 (c)(1),
(2) Date: Apr. 17, 2014

(87) PCT Pub. No.: WO2013/059845

PCT Pub. Date: Apr. 25, 2013

(65) Prior Publication Data

US 2014/0299011 A1 Oct. 9, 2014

(30) Foreign Application Priority Data

Oct. 17, 2011 (ZA) ..... 2011/07995

(51) Int. Cl.
*F42B 3/103* (2006.01)
*F42C 19/08* (2006.01)
*F42B 3/02* (2006.01)

(52) U.S. Cl.
CPC . *F42B 3/02* (2013.01); *F42B 3/103* (2013.01); *F42C 19/0823* (2013.01); *F42C 19/0838* (2013.01)

(58) Field of Classification Search
CPC ..... F42D 1/04; F42D 1/043; F42D 1/045; F42D 1/055; F42D 3/00; F42B 3/10; F42B 3/02; F42B 3/12; F42B 3/121; F42B 3/00; F42B 3/006; F42B 3/103; F42B 3/124; F42B 3/22; F42B 1/00; F42B 1/04; F42B 33/06; F42B 3/18; F42B 12/207; F42C 19/0823; F42C 19/0838
USPC ..... 102/277.1, 277.2, 202.13, 202.14, 205, 102/217, 275.3, 275.4, 275.11, 275.12
See application file for complete search history.

(56) References Cited

U.S. PATENT DOCUMENTS 3,451,341 A * 6/1969 Dittmann ..... F42B 3/10 102/318
3,893,395 A * 7/1975 Kilmer ..... F42D 1/04 102/275.4

(Continued)

FOREIGN PATENT DOCUMENTS

EP 1995551 11/2008
EP 2090860 8/2009

OTHER PUBLICATIONS

International Preliminary Report on Patentability for International Application No. PCT/ZA2012/000075 dated Sep. 19, 2013 (8 pages).

(Continued)

*Primary Examiner* — Troy Chambers
*Assistant Examiner* — Bridget Cochran
(74) *Attorney, Agent, or Firm* — Michael Best & Friedrich LLP

(57) ABSTRACT

An explosive booster assembly (70) which includes a primary module (10) with a first housing (12) and a first booster (14), wherein a detonator (62) is engageable with the first housing, and an auxiliary module (30, 30A) which comprises a second housing (32) with a second booster composition (34), wherein the second housing (32) is interengageable with the first housing (12) to expose the first booster composition (14) to the second composition (34), and wherein any number of substantially identical auxiliary modules (30, 30A) are engageable with one another in order to form a compound booster assembly.

6 Claims, 2 Drawing Sheets

(56) References Cited

U.S. PATENT DOCUMENTS

| | | | | | |
|---|---|---|---|---|---|
| 3,974,772 | A * | 8/1976 | Pelham | F42C 19/12 | 102/202 |
| 4,484,960 | A * | 11/1984 | Rucker | C06B 33/00 | 102/202.5 |
| 5,831,204 | A * | 11/1998 | Lubben | F42C 19/12 | 102/275.4 |
| 5,988,069 | A * | 11/1999 | Bailey | F42B 3/103 | 102/202.14 |
| 6,622,630 | B2 * | 9/2003 | Yang | F42D 1/043 | 102/275.4 |
| 6,848,365 | B2 * | 2/2005 | Avetisian | F42B 3/195 | 102/202.5 |
| 7,073,448 | B2 * | 7/2006 | Bell | E21B 29/02 | 102/306 |
| 2003/0005845 | A1 * | 1/2003 | Hagerty | F42B 5/38 | 102/282 |
| 2009/0255431 | A1 * | 10/2009 | Glatthaar | F42B 3/02 | 102/202.7 |
| 2010/0000436 | A1 * | 1/2010 | Niemeyer | F42B 3/124 | 102/202.7 |

OTHER PUBLICATIONS

International Search Report and the Written Opinion of the International Search Authority for Application No. PCT/ZA2012/000075 dated Feb. 7, 2013 (11 pages).

* cited by examiner

BOOSTER ASSEMBLY

BACKGROUND OF THE INVENTION

This invention relates to a booster for initiating a secondary explosive.

When an explosive is used it is important to obtain optimal release of the potential energy in the explosive. To achieve this the explosive must be initiated properly. This is primarily achieved by using a principle of energy augmentation known as the "explosives train" principle wherein energy released by a detonator is transferred to a booster which is sensitive enough to be initiated by the energy from the detonator. The booster should be capable of releasing enough energy to initiate a main explosive charge which, usually, is not sensitive enough to be initiated directly by the energy from the detonator. The booster is thus a vital part in the explosives train.

A typical commercial booster makes use of a melt-down explosive called Pentolite which can be formed into desired shapes. Pentolite boosters are available in different shapes and forms which are usually dictated by the mass of the booster. Commonly available boosters are in 60 gram, 150 gram and 400 gram sizes. Each booster is normally supplied as a solid casting in a plastic or paper carton casing and has an appropriate formation to receive a detonator which is used to initiate the booster.

The solid one-piece casting which forms a basis for current booster designs can put a strain on production capability and stock levels. A practical problem in this respect is to be able to provide sufficient booster shells of the right capacity for a specific production order. A similar situation pertains to a user who must keep sufficient stock of each potentially usable booster size to meet blasting requirements. If a particular booster size is not available ex-stock then the client may elect to make use of a larger booster to ensure initiation. Often this is not a cost-effective solution to the problem.

An object of the present invention is to address, at least to some extent, the aforementioned situation.

SUMMARY OF THE INVENTION

The invention provides booster assembly kit which includes a primary module and a plurality of substantially identical auxiliary modules, and wherein each auxiliary module is engageable with the primary booster module and with any one of the remaining auxiliary modules.

Preferably the primary module comprises a first housing, a first booster composition inside the first housing, and structure for engaging the first housing with a detonator which is thereby exposed to the first booster composition, and each auxiliary module comprises, at least, a respective second housing and a respective second booster composition inside the second housing, and wherein the first and second housings are interengageable so as to expose the first booster composition to the second booster composition.

The interengagement of the housings may be done in any suitable way.

The housings may be engaged through the use of complementary threaded formations, clips or the like. The invention is not limited in this respect.

The auxiliary modules may be materially the same as the other one. Each auxiliary module may be engageable with any other auxiliary module thereby to expose the respective second booster composition in one auxiliary module to the respective second booster composition in the other auxiliary module. This process can be repeated, as may be required, within reason.

Thus a composite booster assembly can be made from the primary booster module and a number of the auxiliary modules which are serially connected to one another and to the primary booster module.

BRIEF DESCRIPTION OF THE DRAWINGS

The invention is further described by way of example with reference to the accompanying drawings in which.

DESCRIPTION OF PREFERRED EMBODIMENT

Figure 1:
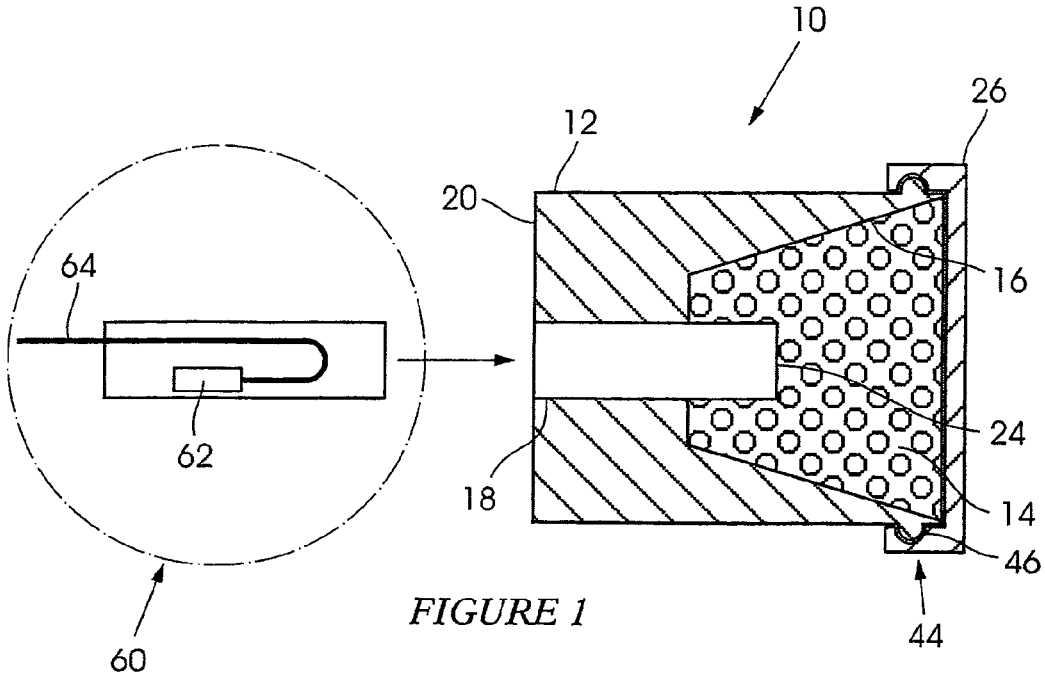
FIG. 1 is a side view in cross section of a primary booster module which is included in a booster assembly kit according to the invention.

FIG. 1 of the accompanying drawings illustrates from one side and in cross section a primary booster module 10 according to the invention. The module includes a tubular housing or sleeve 12 which is made in any appropriate way, for example by using an injection moulding process, from a material such as HDPE. A melt-cast explosive composition or formulation 14 comprising, for example, 100 grams Pentolite, is loaded into a cavity 16 in the housing. A passage 18 which extends from one end 20 of the housing into the cavity 16 has a leading end 24 which, in use, is surrounded by the Pentolite. The composition is sealed inside the cavity by means of a plug or cover 26.

Figure 2:
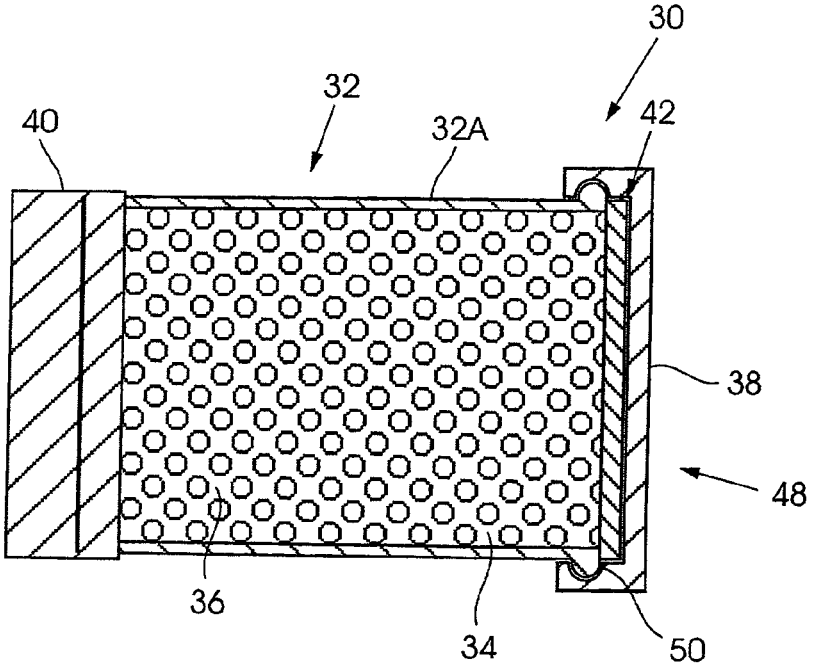
FIG. 2 is a side view in cross-section of an auxiliary booster module which is included in the booster assembly kit of the invention.

FIG. 2 shows an auxiliary module 30 which is one of a plurality of similar modules provided in a booster assembly kit according to the invention.

The module 30 has a first housing 32 which comprises a tubular casing 32A with a blind end 34. The housing is made in a similar way to the housing 12 of FIG. 1. This module 30 is filled with 150 grams of a melt-cast explosive formulation 36 such as Pentolite which is sealed inside the cavity by means of a plug or cover 38. The housing 32 has a leading end 40 which has a sleeve-like clipping mechanism 42 which comprises a shallow circumferential groove 42A on an inner surface of a slightly flexible sleeve 42B. This mechanism is engageable, when required, with a secure attachment action with a trailing end 44 of the housing 12. The end 44 is formed with a circumferential rib 46 which is engageable, with a close fitting and reliable snap action, with the groove 42A. In this way the module 30 can be clipped, in serial fashion, to the module 10 as is shown in cross-section and from one side in FIG. 3 and in more detail in the inset drawing to FIG. 3.

Figure 4:
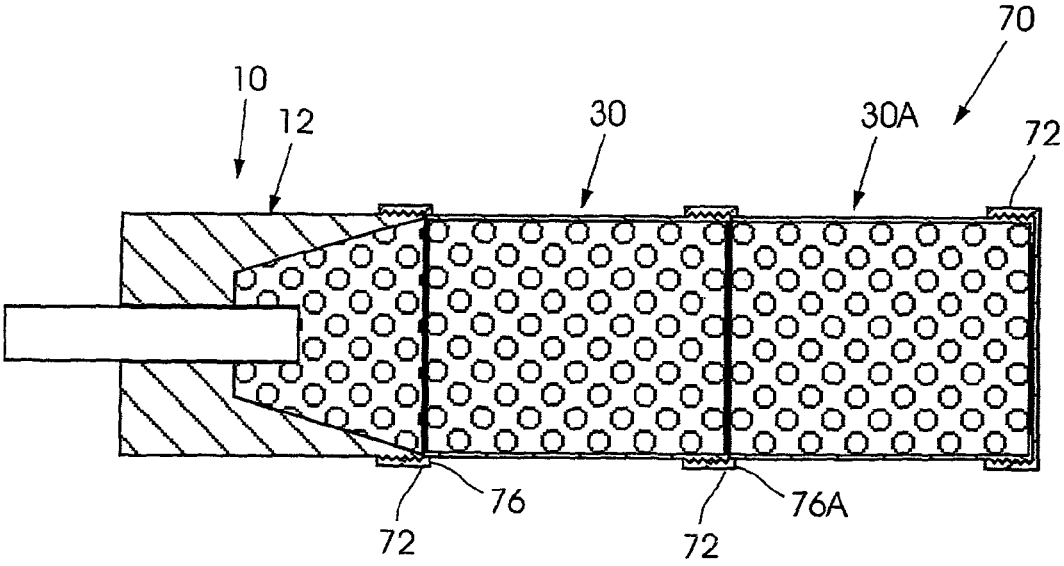
FIG. 4 shows an elongate booster which is made from a plurality of appropriate modules.

A trailing end 48 of the housing 32 has a rib 50 which is similar to the rib 46. This allows the housing 32 to be engaged, with a close fitting and reliable snap action, with the mechanism 40A of a following auxiliary module 30A which, for all practical purposes, is the same as the module 30. This possibility is illustrated in FIG. 4.

The aforementioned process can be continued, within reason, to provide an extended booster assembly which consists of a serially-interconnected arrangement comprising a primary module 10 and a number of auxiliary modules 30, 30A etc.

A holder 60 of conventional design (shown in enlarged detail in a circled inset drawing to FIG. 1) is designed to be inserted, in a secure manner, into the passage 18. The holder contains a detonator 62 and a detonating cord 64 which is connected to the detonator. This arrangement is used in a known way to fire or ignite the composition 14 which, in turn, causes initiation of the PETN charge 36 in an adjacent auxiliary module.

In each module the ratio of the module length X (see FIG. 3) to its diameter Y should not be less than 2,5 in order to meet characteristics which are known to be essential for reliable firing of the module.

The specific quantities of Pentolite included in the primary and auxiliary modules (namely 100 grams and 150 grams) are exemplary only and are non-limiting and can be varied according to requirement.

The material which is used to make the housings 12 and 32 can be any suitable injection-mouldable material. This material can be reinforced with carbon, glass or other fibres, according to requirement, to ensure that it has adequate strength.

The charges 14 and 36 of Pentolite can be formed in situ in the respective housings, or can be prepressed or premoulded to specific sizes which fit closely into the housings.

Figure 3:
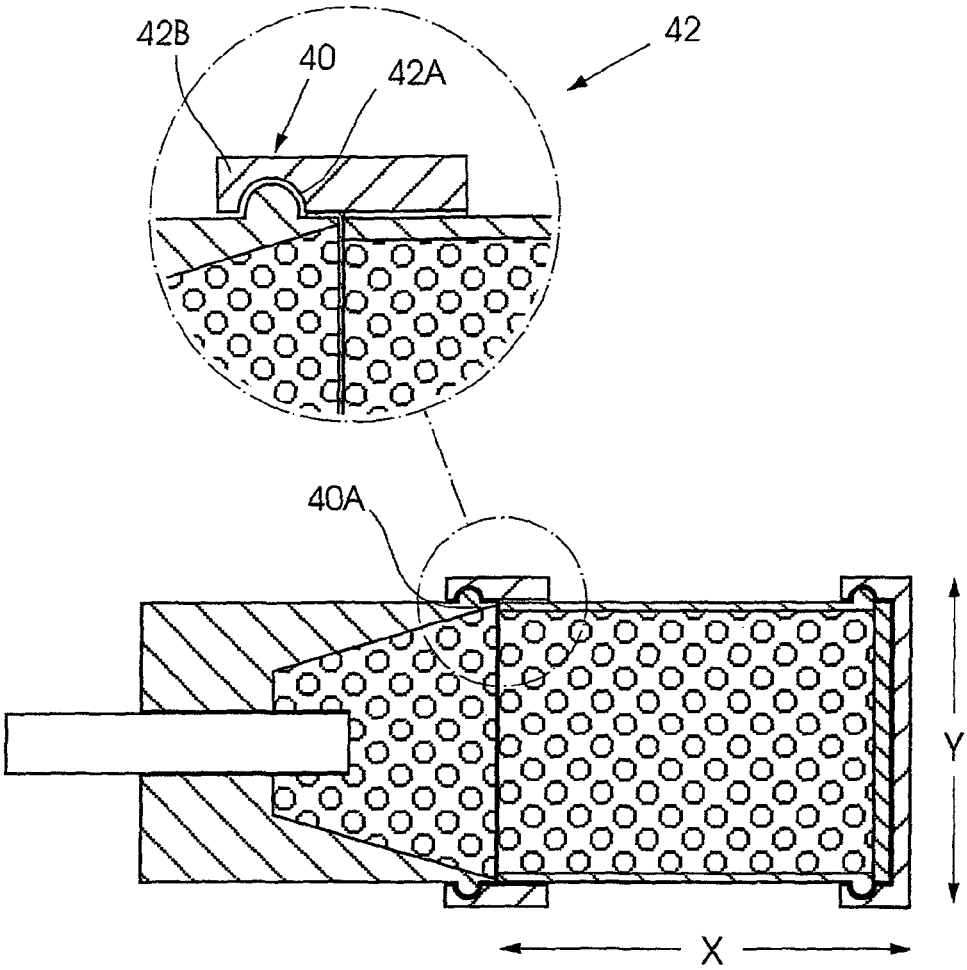
FIG. 3 illustrates how the module of FIG. 1 can be engaged with the module of FIG. 2.

The clip mechanism 42 shown in FIGS. 1 to 3 is exemplary only and non-limiting. FIG. 4 for example shows, in cross-section and from one side, a booster assembly 70 which includes a primary module 10 serially connected to trailing auxiliary modules 30 and 30A. The rib and groove constructions are replaced by, in respect of each module, a fairly coarse thread 72 at a trailing end and on an outer side of the respective housing (12, 32 or 32A). Each auxiliary module housing, at a leading end, has a complementary thread on an inner surface of a forwardly projecting sleeve 76, 76A. These features allow the auxiliary module 30 to be engaged with a screw action with the primary module 12. Similarly the module 30A is engageable with a screw action with the module 30.

The invention claimed is:

1. A booster assembly kit which includes a primary module and a plurality of substantially identical auxiliary modules having substantially identical external diameters, wherein each auxiliary module is engageable with the primary booster module and with any one of the remaining auxiliary modules, wherein the primary module comprises a first housing in the shape of a tubular sleeve and defining a cavity, a first booster composition positioned inside the cavity, and a passage extending from one end of the first housing into the cavity, and wherein the passage is sized to receive a detonator.

2. A kit according to claim 1 wherein each auxiliary module comprises, at least, a respective second housing and a respective second booster composition inside the second housing, and wherein the first and second housings are interengageable so as to expose the first booster composition to the second booster composition.

3. A kit according to claim 2 wherein the first housing includes a circumferentially extending rib and the second housing includes a circumferentially extending groove which is engageable with a snap action with the rib.

4. A kit according to claim 2 wherein the first housing and the second housing include complementary thread formations which are interengageable with a screw action.

5. A kit according to claim 2 wherein the second housing comprises a tubular casing, with a blind end, which includes a cavity in which the second booster composition is located, a cover which seals the composition inside the cavity, and a sleeve which projects from the casing at one end of the casing.

6. A booster assembly kit according to claim 2 wherein each second housing respectively includes a circumferentially extending rib and a circumferentially extending groove which is engageable with a snap action with the rib of another, substantially identical, second housing.

* * * * *